US008493318B2

(12) United States Patent
Kim et al.

(10) Patent No.: US 8,493,318 B2
(45) Date of Patent: Jul. 23, 2013

(54) METHOD AND APPARATUS FOR DRIVING ELECTROPHORETIC DISPLAY

(75) Inventors: Gwan-Hyung Kim, Seoul (KR); Joo-Hoon Lee, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 12/983,579

(22) Filed: Jan. 3, 2011

(65) Prior Publication Data

US 2011/0157136 A1 Jun. 30, 2011

(30) Foreign Application Priority Data

Dec. 31, 2009 (KR) ..... 10-2009-0135868

(51) Int. Cl.
*G09G 3/34* (2006.01)

(52) U.S. Cl.
USPC ..... 345/107; 345/84; 345/691

(58) Field of Classification Search
USPC . 345/51, 78, 107, 691–693; 359/296; 430/32, 430/34, 38; 204/450, 600
See application file for complete search history.

(56) References Cited

U.S. PATENT DOCUMENTS

| | | | | |
|---|---|---|---|---|
| 7,528,822 | B2 * | 5/2009 | Amundson et al. | 345/107 |
| 7,652,656 | B2 * | 1/2010 | Chopra et al. | 345/107 |
| 7,924,412 | B2 * | 4/2011 | Chopra et al. | 356/72 |
| 7,982,710 | B2 * | 7/2011 | Machida et al. | 345/107 |
| 8,174,494 | B2 * | 5/2012 | Kanbayashi et al. | 345/107 |
| 2006/0038772 | A1 * | 2/2006 | Amundson et al. | 345/107 |
| 2006/0170648 | A1 * | 8/2006 | Zhou et al. | 345/107 |
| 2007/0052648 | A1 * | 3/2007 | Zhou et al. | 345/94 |
| 2007/0080926 | A1 * | 4/2007 | Zhou et al. | 345/107 |
| 2007/0296690 | A1 * | 12/2007 | Nagasaki | 345/107 |
| 2008/0150886 | A1 * | 6/2008 | Johnson et al. | 345/107 |

FOREIGN PATENT DOCUMENTS

KR 1020060063880 6/2006

* cited by examiner

*Primary Examiner* — Dmitriy Bolotin
(74) *Attorney, Agent, or Firm* — The Farrell Law Firm, P.C.

(57) ABSTRACT

A method and apparatus for driving an Electrophoretic Display (EPD) where the apparatus includes a controller for controlling an overall operation of the apparatus for driving the EPD, determining data to be displayed on the EPD, and outputting a drive signal; a driver for generating a driving voltage pulse for moving black particles and white particles to display the data on the EPD according to the drive signal output from the controller, thereby controlling the EPD; and the EPD for displaying a representation of the data in white or black according to the driving voltage pulse, wherein the driver generates the driving voltage pulse for moving the black particles or the white particles in such a manner that the driving pulse is divided into a predetermined number of subpulses, and an idle period during which a voltage is not applied intervenes between the respective divided subpulses.

8 Claims, 3 Drawing Sheets

METHOD AND APPARATUS FOR DRIVING ELECTROPHORETIC DISPLAY

PRIORITY

This application claims priority under 35 U.S.C. §119(a) to an application entitled "Method and Apparatus for Driving Electrophoretic Display" filed in the Korean Intellectual Property Office on Dec. 31, 2009, and assigned Serial No. 10-2009-0135868, the disclosure of which is incorporated herein by reference.

BACKGROUND OF THE INVENTION

1. Field of the Invention

The present invention relates generally to a method and apparatus for driving an Electrophoretic Display (EPD).

2. Description of the Related Art

Recently, the concept of digital (or electronic) paper has been contemplated as a new display device incorporating the advantages of existing display devices and printed paper. Digital paper is a type of reflective display that has the most superior visual characteristics among display media, including high resolution, wide angle of view, and bright white background, like natural paper and ink. Digital paper may be implemented on any substrate, such as plastic, metal, and paper substrates. Digital paper is characterized in that it maintains an image even after power supply interruption and requires no backlight power supply, thereby extending the lifetime of a battery of a mobile communication terminal and easily reducing the manufacturing cost and the weight of the terminal. Digital paper is further characterized in that it can be applied to a larger display area than any other display devices because it can be implemented in a wide area in the same manner as existing paper. Digital display has also a memory function for preventing a displayed image from disappearing, even without power supply.

Digital paper may be implemented using an EPD. The EPD displays data in white or black according to a voltage applied between both ends thereof, and electrophoresis and microcapsules are applied in constructing the EPD. FIG. 1 illustrates a typical cell structure of an EPD, and also shows an operating principle of the EPD in section. The EPD may be formed by manufacturing transparent microcapsules each including black particles 40 and white particles 30 suspended in a colored fluid, combining the microcapsules with a binder 50, and then positioning the microcapsules combined with the binder 50 between upper and lower transparent electrodes 20 that are in contact with the inner sides of upper and lower substrates 10. When a positive voltage is applied, negatively charged fine ink particles are moved toward the surface of the EPD to display the color of the fine ink particles. To the contrary, when a negative voltage is applied, the negatively charged fine ink particles are moved downward, so that the color of the fluid can be observed. In this way, a text or an image is displayed.

The EPD is dependent on the electrostatic movement of particles floating in a transparent suspension. When a positive voltage is applied, positively charged white particles 30 electrostatically are moved to an electrode on an observer's side, and the moved white particles 30 reflect light. Contrarily, when a negative voltage is applied, the white particles 30 are moved to an electrode that is away from the observer, and the black particles 40 are moved to the upper portions of the capsules. Since the moved black particles 40 absorb the light, the observer observes the black color. Once the electrostatic movement has occurred at any polarity, the particles remain in their positions, even when the applied voltage is interrupted, and thus a memory device having bistability is provided. Dissimilar to this, an electrophoretic capsule using a single kind of particles is also proposed, which is formed in such a manner that a transparent polymer capsule includes white charged particles floating in a fluid that is dyed a dark color.

In driving the EPD, the same voltage must be applied to both the black particles and the white particles only for the same period of time in order to satisfy a Direct Current (DC) balancing condition and avoid an overdrive state. If this consideration is not kept, then the lifetime and display function of the EPD may be deteriorated.

However, when the same voltage is applied to the black particles and the white particles only for the same period of time in order to move the particles, an afterimage is caused by the difference in the mobility characteristics of the black and white particles.

FIG. 2 illustrates an example of a driving voltage pulse for driving a typical EPD. At the same voltage and for the same period of time, a positively charged black particle has good mobility whereas a negatively charged white particle has relatively poor mobility in comparison with the black particle. Assuming that the particle is moved for a period of time of 180 ms, when the display state of the EPD first transitions from white 210 to black 220, and then transitions from black 220 to white 230 again, the difference in the mobility characteristics of the black and white particles results in the lower reflectance of white 230 than that of white 210. This means that a user still observes previously displayed data, that is, an afterimage of previously displayed data is displayed to a user.

Therefore, there is a need for a way to drive an EPD without an afterimage of displayed data while satisfying a DC balancing condition.

SUMMARY OF THE INVENTION

Accordingly, the present invention has been made to solve at least the above-mentioned problems occurring in the prior art, and the present invention provides a method and apparatus for driving an EPD, which can eliminate an afterimage of display data while satisfying a DC balancing condition when the EPD is driven.

In accordance with an aspect of the present invention, there is provided an apparatus for driving an EPD, the apparatus including a controller for controlling an overall operation of the apparatus for driving the EPD, determining data to be displayed on the EPD, and outputting a drive signal; a driver for generating a driving voltage pulse for moving black particles and white particles to display the data on the EPD according to the drive signal output from the controller, thereby controlling the EPD; and the EPD for displaying a representation of the data in white or black according to the driving voltage pulse, wherein the driver generates the driving voltage pulse for moving the black particles or the white particles in such a manner that the driving pulse is divided into a predetermined number of subpulses, and an idle period during which a voltage is not applied intervenes between the respective divided subpulses.

In accordance with another aspect of the present invention, there is provided a method of driving an EPD in an apparatus for driving the EPD, which includes the EPD for displaying a representation of data in white or black according to a driving voltage pulse by determining the data to be displayed on the EPD, and generating a drive signal; generating the driving voltage pulse for moving black particles and white particles according to the drive signal in such a manner that the driving voltage pulse for moving the black particles or the white particles to display the data is divided into a predetermined number of subpulses, and an idle period during which a voltage is not applied intervenes between the respective divided subpulses; and driving the EPD according to the generated driving voltage pulse.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF EMBODIMENTS OF THE PRESENT INVENTION

Figure 1:
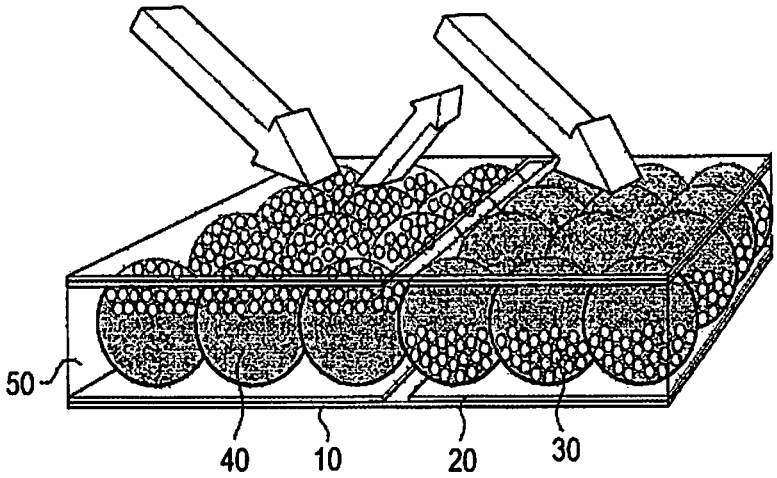
FIG. 1 is a diagram illustrating a structure of a typical EPD.
Figure 2:
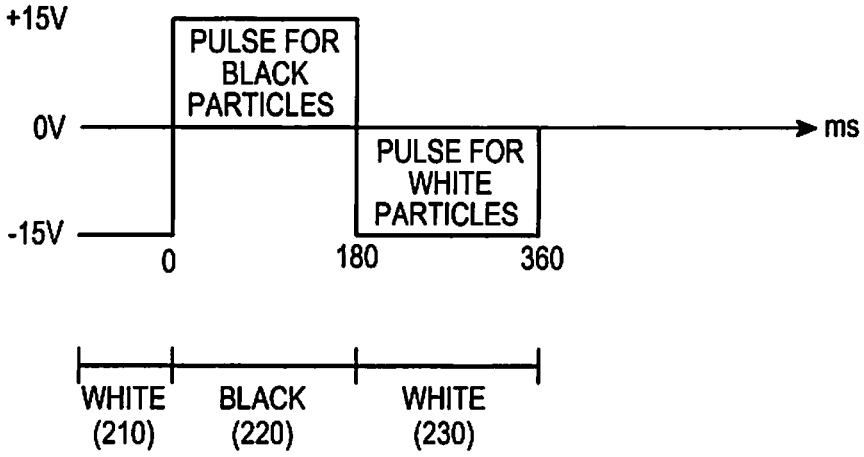
FIG. 2 is a graph illustrating an example of a driving voltage pulse for driving a typical EPD.

Hereinafter, embodiments of the present invention are described in detail with reference to the accompanying drawings. In the following description, only parts necessary for understanding operations of the present invention will be described. However, those skilled in the art will appreciate that the disclosed concepts and concrete embodiments of the invention as described below to solve the technical problem of the invention may be changed or modified. Further, those skilled in the art will appreciate that the disclosed concepts and structures and equivalents thereof do not depart from the scope and spirit of the invention in the widest form as disclosed in the accompanying claims. In the following description, the same elements will be designated by the same reference numerals although they are shown in different drawings. Further, a detailed description of known functions and configurations incorporated herein will be omitted so as not to make the subject matter of the present invention rather unclear. The terms as used in the following description are defined considering the functions in the present invention and may vary depending on the intention or usual practice of a user or operator. Therefore, the definitions should be made based on the entire contents of the description.

The present invention provides a method and apparatus for driving an electrophoresis display device referred to as an EPD that eliminates an afterimage caused by the asymmetric movements of black particles and white particles, which occur in the process of driving the EPD at the same potential for the same period of time of applying a voltage. To this end, a voltage for moving the black and white particles of the EPD is applied at the same amplitude level only for the same period of time so as to satisfy a DC balancing condition and thus avoid an overdrive state, wherein the voltage is applied in the form of a driving pulse that is divided into subpulses at regular time intervals, so that the mobility characteristics of the black particles and the white particles are adjusted in such a manner as to be the same.

Figure 3:
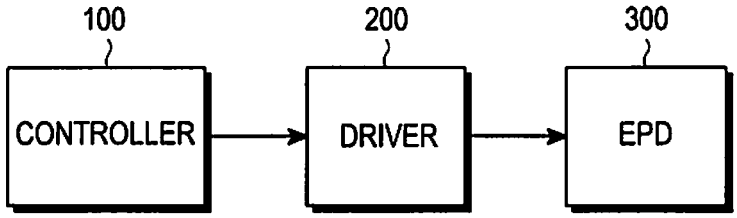
FIG. 3 is a block diagram illustrating a structure of an apparatus for driving an EPD in accordance with an embodiment of the present invention.

FIG. 3 illustrates a structure of an apparatus for driving an EPD according to an embodiment of the present invention. Referring to FIG. 3, the apparatus for driving an EPD includes a controller 100, a driver 200, and an EPD 300.

The EPD 300 displays data according to a voltage that is output from a driver to be described below. That is, the EPD 300 displays a representation of data in white or black according to the difference between voltages applied to both ends thereof. The EPD 300 has a structure in which a plurality of microcapsules as an electrophoresis element, including of white particles, black particles, and fluid, are positioned between transparent electrodes.

The controller 100 controls the overall operation of the apparatus for driving an EPD, determines data to be displayed on the EPD 300, and outputs a drive signal for controlling the operation of the driver 200 according to the determined data.

The driver 200 generates a driving voltage pulse for moving the black particles and the white particles according to the drive signal output from the controller 100, thereby driving the EPD 300. Under the control of the controller 100, the driver 200 applies a driving voltage in the form of an operating pulse to one electrode of the EPD 300 and applies a reference voltage in the form of a pulse to the other electrode to thereby move the white particles and the black particles according to the difference between the voltages applied to both the electrodes and the corresponding voltage direction.

When the driver 200 drives the EPD 300, it may alternately generate a driving voltage pulse for moving the black particles and a driving voltage pulse for moving the white particles at the same amplitude level for the same period of time.

In an embodiment of the present invention, the controller 100 may control the driver 200 to generate a driving voltage pulse for the black or white particles in such a manner that the driving voltage pulse is divided into a predetermined number of subpulses, and an idle period during which a voltage is not applied intervenes between the respective divided subpulses.

Further, in an embodiment of the present invention, the controller 100 may control the driver 200 to generate a driving voltage pulse for the white particles in such a manner that the driving voltage pulse is divided into two subpulses with the same duration, and an idle period with the same duration as the divided subpulses intervenes between the divided subpulses.

Further, in another embodiment of the present invention, the controller 100 may control the driver 200 to generate a driving voltage pulse for the black particles in such a manner that the driving voltage pulse is divided into four subpulses with the same duration, and idle periods with the same duration as the divided subpulses intervene between the divided subpulses.

Further, the controller 100 may control the mobility of the particles by adjusting the duration of the idle state.

The generation of a driving voltage pulse may be controlled by the controller 100, as described above, but the driver 200 itself may also control the generation of a driving voltage pulse.

Figure 4:
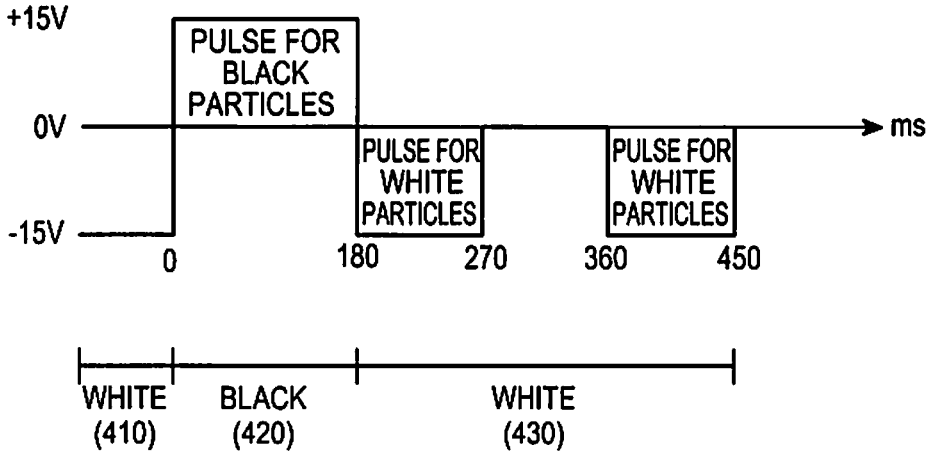
FIG. 4 is a graph illustrating an example of a driving voltage pulse for use in applying a driving voltage to an EPD in accordance with an embodiment of the present invention.

FIG. 4 illustrates an example of a driving voltage pulse for use in applying a driving voltage to an EPD according to an embodiment of the present invention.

Referring to FIG. 4, this embodiment of the present invention provides a way to apply a voltage for driving an EPD, in which a driving voltage pulse for moving black particles is applied once for a period of time of 180 ms, and a driving voltage pulse for moving white particles is applied two times at time intervals of 90 ms. The driving voltage pulse for the white particles is divided into two subpulses, each of which is applied for a duration corresponding to half of the duration of the driving voltage pulse for the black particles, and an idle period intervenes between the divided subpulses. In this way, the white particles, the mobility of which is relatively lower than the black particles, has increased mobility, so that when a display state transitions from white 410 to black 420 and then from black 420 to white 430, the difference between the reflectance of white 410 displayed first and the reflectance of white 430 displayed again later on is not perceivable.

Figure 5:
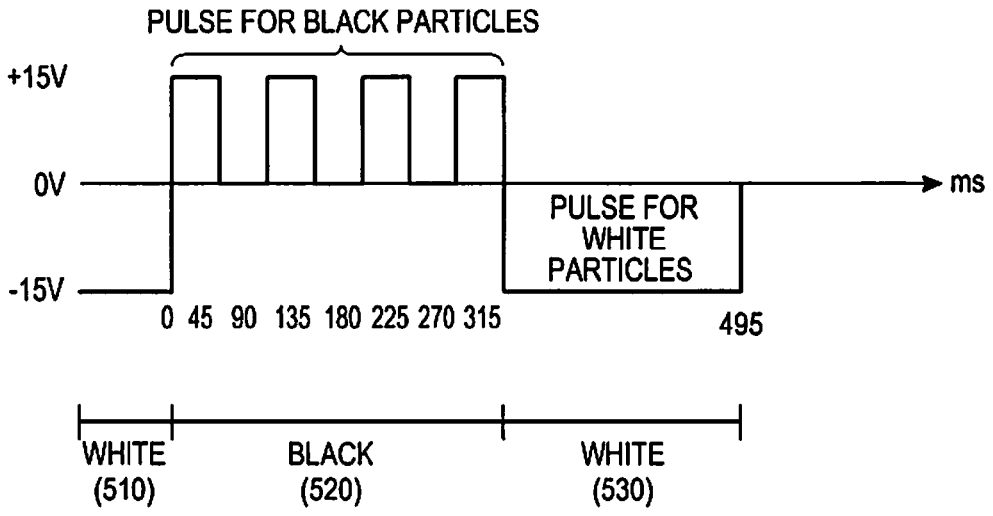
FIG. 5 is a graph illustrating an example of a driving voltage pulse for use in applying a driving voltage to an EPD in accordance with another embodiment of the present invention.

FIG. 5 illustrates an example of a driving voltage pulse for use in applying a driving voltage to an EPD according to another embodiment of the present invention. In this embodiment of the present invention, voltage for driving an EPD is applied such that driving voltage pulse for moving black particles having relatively higher mobility than the white particles is applied four times at time intervals of 45 ms. That is, as shown in FIG. 5, the driving voltage pulse for the black particles is divided into four subpulses each having a duration of 45 ms, and an idle period of 45 ms intervenes between the respective divided subpulses.

Applying the pulse in this way lowers the mobility of the black particles compared to applying a non-divided driving voltage pulse. As a result, when a display state transitions from white 510 to black 520 and then from black 520 to white 530, the difference between the reflectance of white 510 displayed first and the reflectance of white 530 displayed again later on is not perceivable.

When a driving voltage pulse is applied over several times through subpulses into which the driving voltage pulse is divided and between which an idle period intervenes, as illustrated in FIGS. 4 and 5, the mobility of EPD particles can be changed to an increased or decreased level according to the division cycle of the driving voltage pulse.

Figure 6:
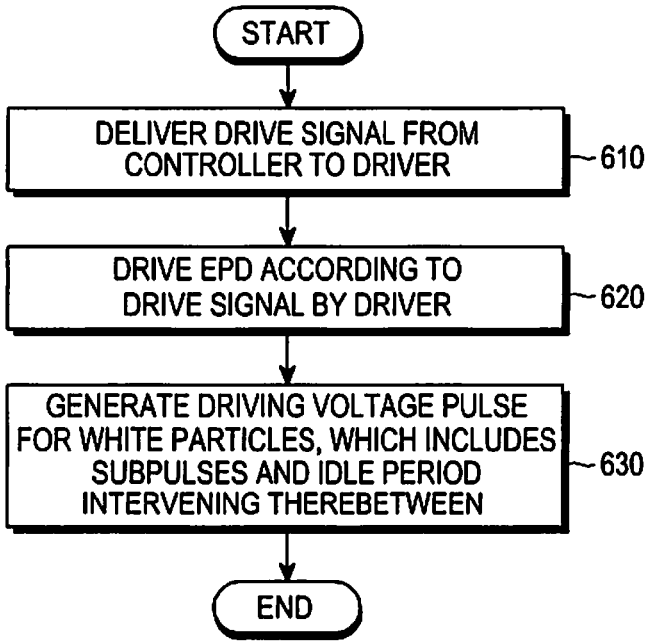
FIG. 6 is a flowchart illustrating an operation of driving an EPD in accordance with an embodiment of the present invention.

FIG. 6 illustrates an operation of driving an EPD according to an embodiment of the present invention.

Referring to FIG. 6, when an EPD is driven, the controller 100 determines data to be displayed, generates a drive signal according to the data to be displayed, and then delivers the generated drive signal to the driver 200 in step 610. Next, in step 620, the deriver 200 generates a driving voltage pulse for black particles and a driving voltage pulse for white particles respectively according to the delivered drive signal, and drives the EPD 300 by using the generated driving voltage pulse. In step 630, in generating the driving voltage pulse for the white particles to drive the EPD 300, the driver 200 divides the driving voltage pulse into two subpulses with a duration corresponding to half of the duration of the driving voltage pulse for the black particles, and applies the two divided subpulses while interposing an idle period with the same duration as the divided subpulses between the two divided subpulses.

Further, according to another embodiment of the present invention, the driver 200 divided the driving voltage pulse for the black particles, instead of the driving voltage pulse for the white particles, into four subpulses, and applies the four divided subpulses while interposing idle periods with the same duration as the divided subpulses between the four divided subpulses.

By driving the EPD 300 in this way, the present invention can eliminate an afterimage occurring when the EPD 300 is driven.

As described above, when an EPD is driven, the present invention can overcome the difference between the inherent mobility characteristics of white particles and black particles by adjusting a driving voltage pulse, thereby definitely displaying data on the EPD without an afterimage of previously displayed data while satisfying a DC balancing condition. Further, the present invention provides a way to compensate for the quality problem in the final product state, which is caused by a deviation between lots in the manufacturing process of an EPD.

While the invention has been shown and described with reference to certain embodiments thereof, it will be understood by those skilled in the art that various changes in form and details may be made therein without departing from the spirit and scope of the invention as defined by the appended claims.

What is claimed is:

1. An apparatus for driving an Electrophoretic Display (EPD), the apparatus comprising:

a controller for controlling an overall operation of the apparatus for driving the EPD, determining data to be displayed on the EPD, and outputting a drive signal;

a driver for generating a driving voltage pulse for moving black particles and white particles to display the data on the EPD according to the drive signal output from the controller, thereby controlling the EPD; and the EPD for displaying a representation of the data in white or black according to the driving voltage pulse, wherein the driver generates the driving voltage pulse for moving the black particles or the white particles in such a manner that the driving pulse is divided into a predetermined number of subpulses, and an idle period during which a voltage is not applied intervenes between the respective divided subpulses, and wherein the driver generates the driving voltage pulse in such a manner that the driving voltage pulse for moving the white particles to display the data in white is divided into two subpulses with the same duration which is equal to a half of a duration of the driving voltage pulse for moving the black particles to display the data in black, and an idle period intervenes between the divided subpulses.

2. The apparatus as claimed in claim 1, wherein the idle period has the same duration as the divided subpulses.

3. The apparatus as claimed in claim 1, wherein the driver controls mobility of the particles by adjusting the duration of the idle period.

4. The apparatus as claimed in claim 1, wherein the driving voltage pulse for moving the white particles to display the data in white is divided into only two subpulses.

5. A method of driving an Electrophoretic Display (EPD) in an apparatus for driving the EPD, which includes the EPD for displaying a representation of data in white or black according to a driving voltage pulse, the method comprising:

determining the data to be displayed on the EPD, and generating a drive signal;

generating the driving voltage pulse for moving black particles and white particles according to the drive signal in such a manner that the driving voltage pulse for moving the black particles or the white particles to display the data is divided into a predetermined number of subpulses, and an idle period during which a voltage is not applied intervenes between the respective divided subpulses; and driving the EPD according to the generated driving voltage pulse, wherein, when the driving voltage pulse is generated, the driving voltage pulse for moving the white particles to display the data in white is divided into two subpulses with the same duration which is equal to a half of a duration of the driving voltage pulse for moving the black particles to display the data in black, and an idle period intervenes between the divided subpulses.

6. The method as claimed in claim 5, wherein, the idle period has the same duration as the divided subpulses.

7. The method as claimed in claim 5, wherein, when the driving voltage pulse is generated, mobility of the particles is controlled by adjusting the duration of the idle period.

8. The method as claimed in claim 5, wherein the driving voltage pulse for moving the white particles to display the data in white is divided into only two subpulses.

* * * * *